US010935253B2

(12) United States Patent
Rossato et al.

(10) Patent No.: US 10,935,253 B2
(45) Date of Patent: Mar. 2, 2021

(54) SWITCH BOX FOR A COOKTOP APPLIANCE

(71) Applicant: Electrolux Home Products, Inc., Charlotte, NC (US)

(72) Inventors: Agostino Rossato, Forli (IT); Claudio Guzzo, Forli (IT); Valerio Verdoliva, Forli (IT)

(73) Assignee: Electrolux Home Products, Inc., Charlotte, NC (US)

( * ) Notice: Subject to any disclaimer, the term of this patent is extended or adjusted under 35 U.S.C. 154(b) by 343 days.

(21) Appl. No.: 16/007,217

(22) Filed: Jun. 13, 2018

(65) Prior Publication Data

US 2019/0383494 A1 Dec. 19, 2019

(51) Int. Cl.

| | |
|---|---|
| ***H05B 1/02*** | (2006.01) |
| ***F24C 7/08*** | (2006.01) |
| ***F24C 15/10*** | (2006.01) |

(52) U.S. Cl.

CPC ..... *F24C 7/083* (2013.01); *F24C 15/106* (2013.01); *H05B 1/0266* (2013.01)

(58) Field of Classification Search

CPC ..... F24C 7/083; F24C 15/106; H05B 3/0076; H05B 1/02; H05B 1/0261; H05B 1/0266

USPC ..... 219/483–486, 412–414, 443.1, 446.1, 219/446.11, 448.12, 494, 497

See application file for complete search history.

(56) References Cited

U.S. PATENT DOCUMENTS

| | | | | |
|---|---|---|---|---|
| 4,656,337 | A * | 4/1987 | Lastofka | A47J 37/0635 219/386 |
| 5,931,150 | A | 8/1999 | Bowen et al. | |
| 6,672,867 | B1 | 1/2004 | Du | |
| 6,936,794 | B2 * | 8/2005 | Zhang | A47F 3/001 219/385 |
| 7,399,939 | B2 | 7/2008 | Hettinger et al. | |
| 7,401,610 | B1 | 7/2008 | Cherry | |
| 7,902,476 | B2 | 3/2011 | Querejeta Andueza et al. | |
| 8,063,342 | B2 * | 11/2011 | Hines, Jr. | F24C 15/325 219/400 |
| 8,729,432 | B2 | 5/2014 | Lin et al. | |
| 8,967,019 | B2 | 3/2015 | O'Keefe et al. | |
| 9,103,553 | B2 | 8/2015 | Daughtridge, Jr. et al. | |
| 9,341,381 | B2 | 5/2016 | Braden et al. | |
| 9,557,063 | B2 | 1/2017 | Cadima | |
| 9,605,852 | B2 | 3/2017 | Porraro | |
| 9,666,388 | B2 | 5/2017 | Weaver et al. | |
| 9,696,038 | B2 | 7/2017 | Braden et al. | |
| 2004/0035845 | A1 * | 2/2004 | Moon | A47J 37/0623 219/400 |
| 2006/0254573 | A1 | 11/2006 | Steinman et al. | |
| 2009/0027356 | A1 | 1/2009 | Heimann et al. | |
| 2011/0146650 | A1 | 6/2011 | Karamatic et al. | |
| 2011/0203571 | A1 | 8/2011 | Schnetzer et al. | |
| 2015/0168987 | A1 | 6/2015 | O'Keefe | |
| 2015/0323192 | A1 | 11/2015 | Verrat-Debailleul et al. | |

(Continued)

*Primary Examiner* — Mark H Paschall

(74) *Attorney, Agent, or Firm* — Pearne & Gordon LLP

(57) ABSTRACT

A switch box for housing a switch underneath a cooktop is disclosed. The switch is connected to a control member accessible above the cooktop to accept user inputs. The switch box has an air-insulation channel defined between first and second spaced-apart barrier walls. In desirable embodiments the first and second barrier walls are integrally formed with other components of the switch box from plastic as a single-piece part.

20 Claims, 5 Drawing Sheets

(56) References Cited

U.S. PATENT DOCUMENTS

| | | | | |
|---|---|---|---|---|
| 2016/0097541 | A1 | 4/2016 | Choi | |
| 2016/0215987 | A1 | 7/2016 | Braden et al. | |
| 2017/0067647 | A1* | 3/2017 | Wie | F24C 15/006 |
| 2017/0227231 | A1 | 8/2017 | Pionek et al. | |

* cited by examiner

SWITCH BOX FOR A COOKTOP APPLIANCE

BACKGROUND OF THE INVENTION

1. Field of the Invention

This application relates generally to a switch box, and more specifically to a switch box for a cooking appliance, particularly a cooktop, that houses a switch connected to a control member of the cooking appliance.

2. Description of Related Art

Cooktops can include a switch box in order to house a switch therein. The switch is associated with a control member accessible by a user (such as a knob) to operate the switch in order to control an associated function of the appliance. Generally, the switch box is disposed below a top plate of the cooktop and the switch housed therein can include a rotatable shaft that extends above the top plate to engage the control member. Conventionally, the switch box is manufactured by bending sheet metal into a desired shape. Due to the use of such material, the switch box requires a substantial amount of thermal insulation to protect housed switches from excessive temperatures. For example, a metal switch box generally includes a fiberglass layer, a sheet-metal spacer, and another (external) fiberglass layer having a reflective aluminum skin thereon. These additional layers provide adequate protection for the switches, but increase cost and complexity of the overall switch box design.

BRIEF SUMMARY OF THE INVENTION

In accordance with one aspect, there is provided a switch box for housing a switch therein. The switch is connected to a control member of a cooktop appliance. The switch box comprises a top wall and a first barrier wall extending downward from an edge of the top wall. A second barrier wall is disposed adjacent and being spaced from the first barrier wall to thereby define an air-insulation channel therebetween. An internal chamber is defined at least partially by the top wall and the first barrier wall. The internal chamber is configured to house a switch therein.

In accordance with another aspect, there is provided a cooking appliance comprising a cooktop having a top plate, an electric heating element disposed at the top plate, and a control member. The control member is located in a control area of the cooktop and is accessible thereabove by a user in order to adjust a power output of the electric heating element. The cooking appliance further includes a control box assembly disposed under the top plate beneath said control area. The control box assembly includes a switch box that houses a switch that is connected to the control member via a stem of the switch that extends through a stem aperture in the top wall of the switch box and through an aperture in said top plate. The switch box includes a first barrier wall extending downward from the top wall thereof. an internal chamber is at least partially defined by the top wall and the first barrier wall. The switch is housed in the internal chamber. A second barrier wall is disposed adjacent and being spaced from the first barrier wall to thereby define an air-insulation channel therebetween.

DETAILED DESCRIPTION

Relative language used herein is best understood with reference to the drawings, in which like numerals are used to identify like or similar items or features.

Figure 1:
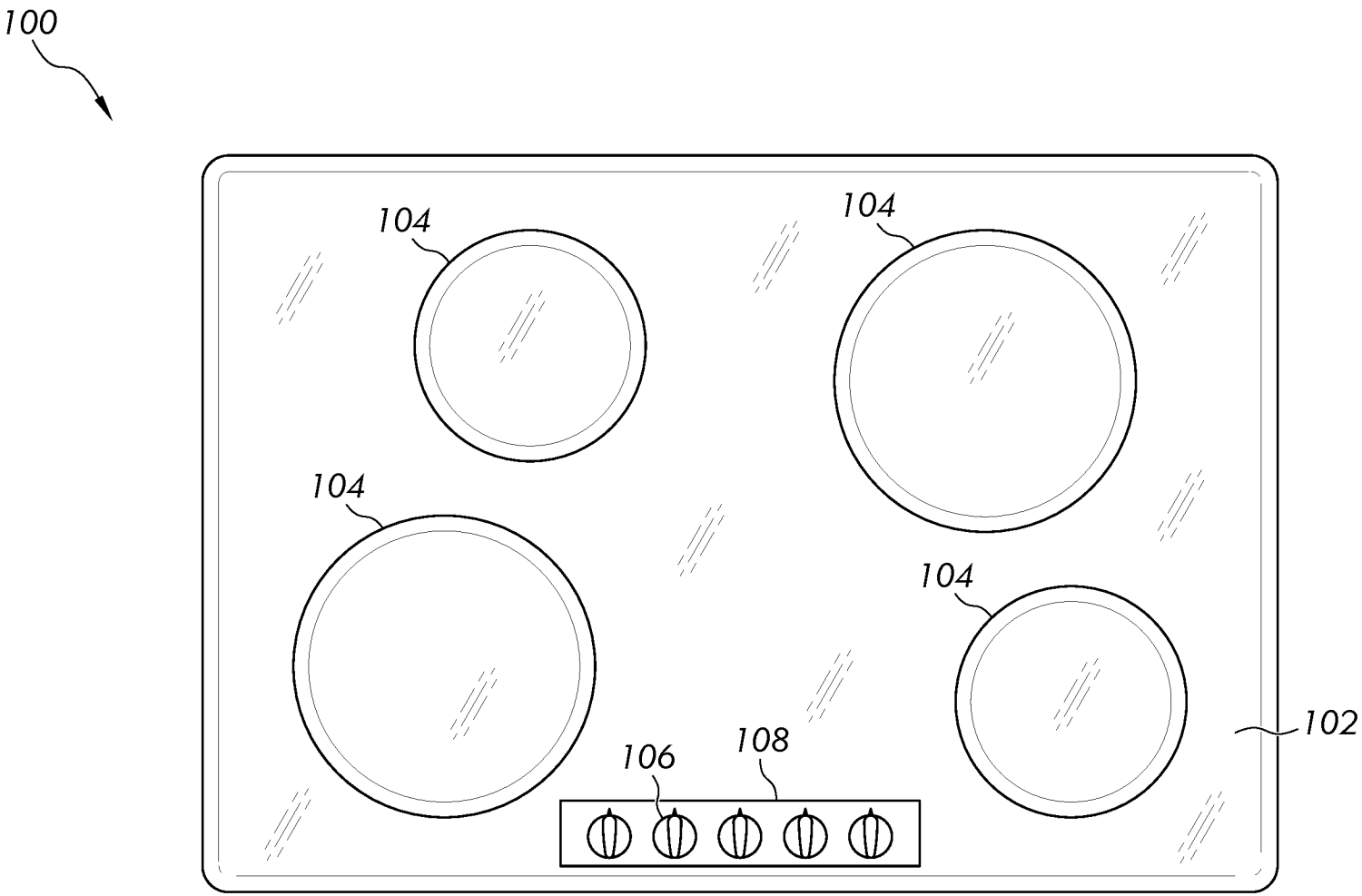
FIG. 1 is a schematic top view of a cooking appliance showing the cooktop thereof.

Referring now to the drawings, FIG. 1 schematically depicts a cooking appliance, and more specifically, a cooktop 100 thereof. The cooktop 100 can be part of a combination appliance wherein the cooktop 100 is disposed above an additional cooking unit or other appliance module (e.g., gas oven, conventional electric oven, convection oven, steam oven, etc.). Alternatively, the cooktop 100 can be a stand-alone appliance independent of any additional cooking appliance and configured to be mounted in a countertop. Further still, the cooktop 100 can be a portable appliance (e.g., hot plate) capable of being transported to different locations.

The cooktop 100 includes a top plate 102 that generally lies along a horizontal plane. The top plate 102 may be a ceramic top plate (i.e., the top plate 102 is manufactured from ceramic materials). Alternatively, the top plate 102 may be manufactured from other materials (e.g., stainless steel, glass-ceramic, porcelain, enamel, glass, etc.). The top plate 102 can be entirely flat and planar. Alternatively, the top plate 102 may include indentations and/or protrusions that help guide the placement of utensils thereon, or it may have contoured portions for other purposes.

The cooktop 100 further includes at least one electric heating element 104 (e.g., resistive coil(s), radiant element, induction element, etc.). As shown, the cooktop 100 includes four heating elements 104 wherein two heating elements 104 are of a large size and the other two heating elements 104 are of a small size. It is to be understood that the cooktop 100 can have any number of heating elements 104 wherein said heating elements 104 are arranged in any order and have any size.

The heating elements 104 are provided and configured to heat a cooking utensil disposed on the top plate 102 in the vicinity of the respective heating elements 104, or in some embodiments placed directly on or above the heating element(s) 104. The heating elements 104 can be provided, disposed and used in a conventional manner or according to any suitable configuration and will not be further described.

A power source (not shown) is connected to one or more of the heating elements 104 and is configured to provide an output of power thereto. A control member 106 accessible from above the cooktop 100 permits a user to control the output of power provided to the heating element(s) 104 in a conventional manner. As will be further described below, the control member 106 can be a rotary knob that adjusts the power provided to the heating element(s) 104 based on a degree of rotation. However, the control member 106 is not limited to such a configuration and may be any other type of control element (e.g., mechanical buttons, touch-sensitive buttons, levers, slides, etc.). The control member 106 can extend, at least partially, above the top plate 102, or it can lie on (or even below) the horizontal plane of the top plate 102—as long as it is user-accessible from above the top plate 102.

The control member 106 is located in a control area 108 of the cooktop 100. As shown, the control area 108 can be disposed adjacent a front edge of the top plate 102. However, the control area 108 can be located anywhere on the top plate 102. Alternatively, the control area 108 may be located remote from the top plate 102, such as adjacent to that plate along a perimeter thereof and still accessible from above the appliance. For example, the control area 108 may be located on a panel disposed adjacent to the top plate 102.

Figure 2:
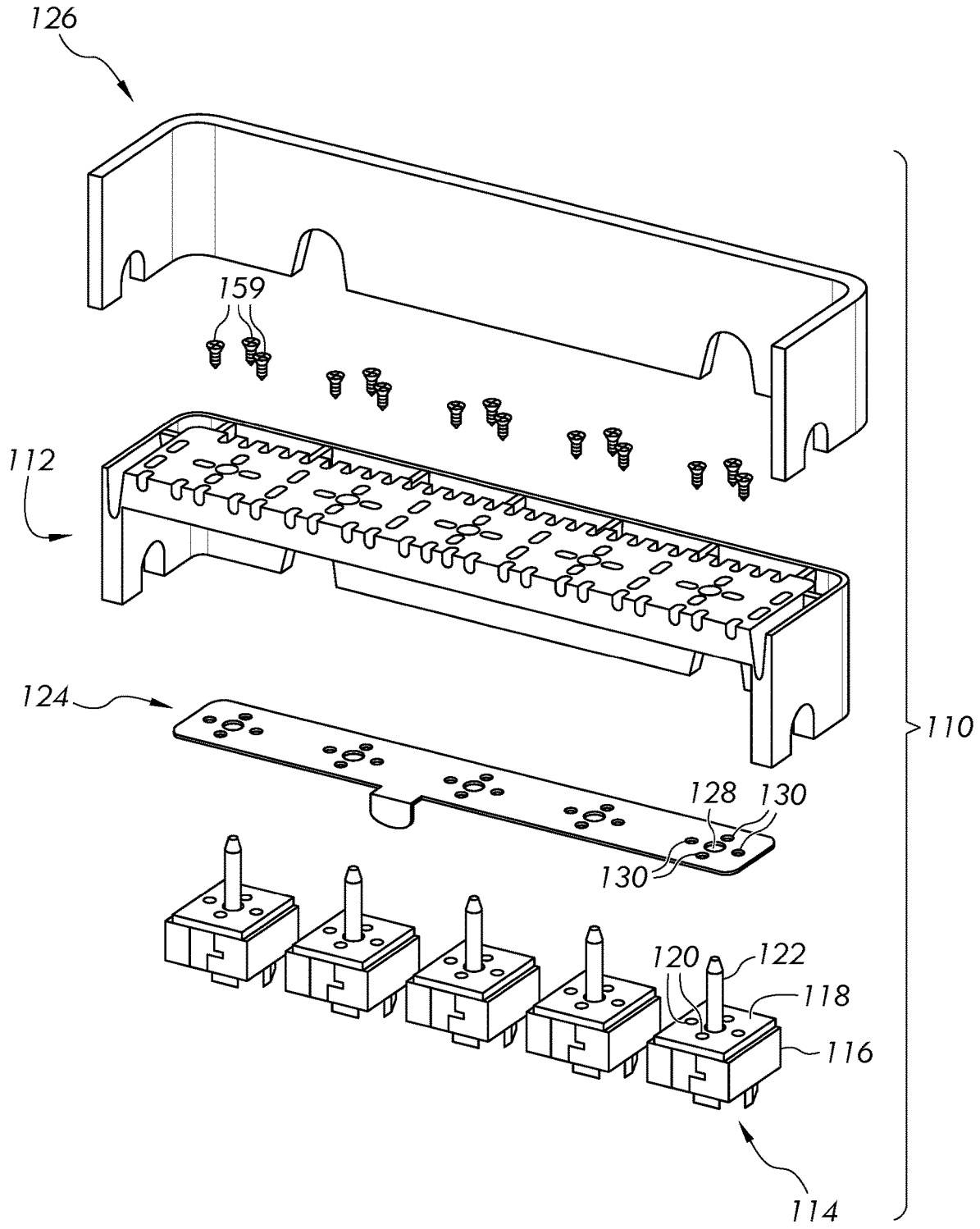
FIG. 2 is an exploded rear perspective view of a control box assembly for the cooking appliance of FIG. 1.

Moving on to FIG. 2, the cooktop 100 further includes a control box assembly 110, typically disposed below the top plate 102, beneath the control area 108. The control box assembly 110 includes a switch box 112 that is configured to house at least one switch 114 therein. The switch 114 comprises a housing 116 having a top surface 118 with housing apertures 120 formed therein. Moreover, the switch 114 includes a stem 122 extending upward away from the housing 116, toward and through the top surface 118 where it engages the control member 106 above the top plate 102 in a conventional manner.

The control box assembly 110 also includes a grounding plate 124 and an outer insulation layer 126 that surrounds a perimeter wall of the switch box 112, providing an additional layer of insulation for the switch 114 housed therein. The grounding plate 124 is a metal plate disposed between the switch box 112 and the top surface 118 of the switch 114 and provides grounding for the switch 114. The grounding plate 124 further includes plate first apertures 128 and plate second apertures 130. The plate first apertures 128 permit respective stems 122 of a plurality of switches 114 within the switch box 112 to extend through the grounding plate 124 such that a bottom surface of the ground plate 124 physically contacts the top surface 118 of the housing. The plate second apertures 130 are configured to align with the housing apertures 120 in the top surfaces 118 of respective switch housings 116 when installed.

Figure 3:
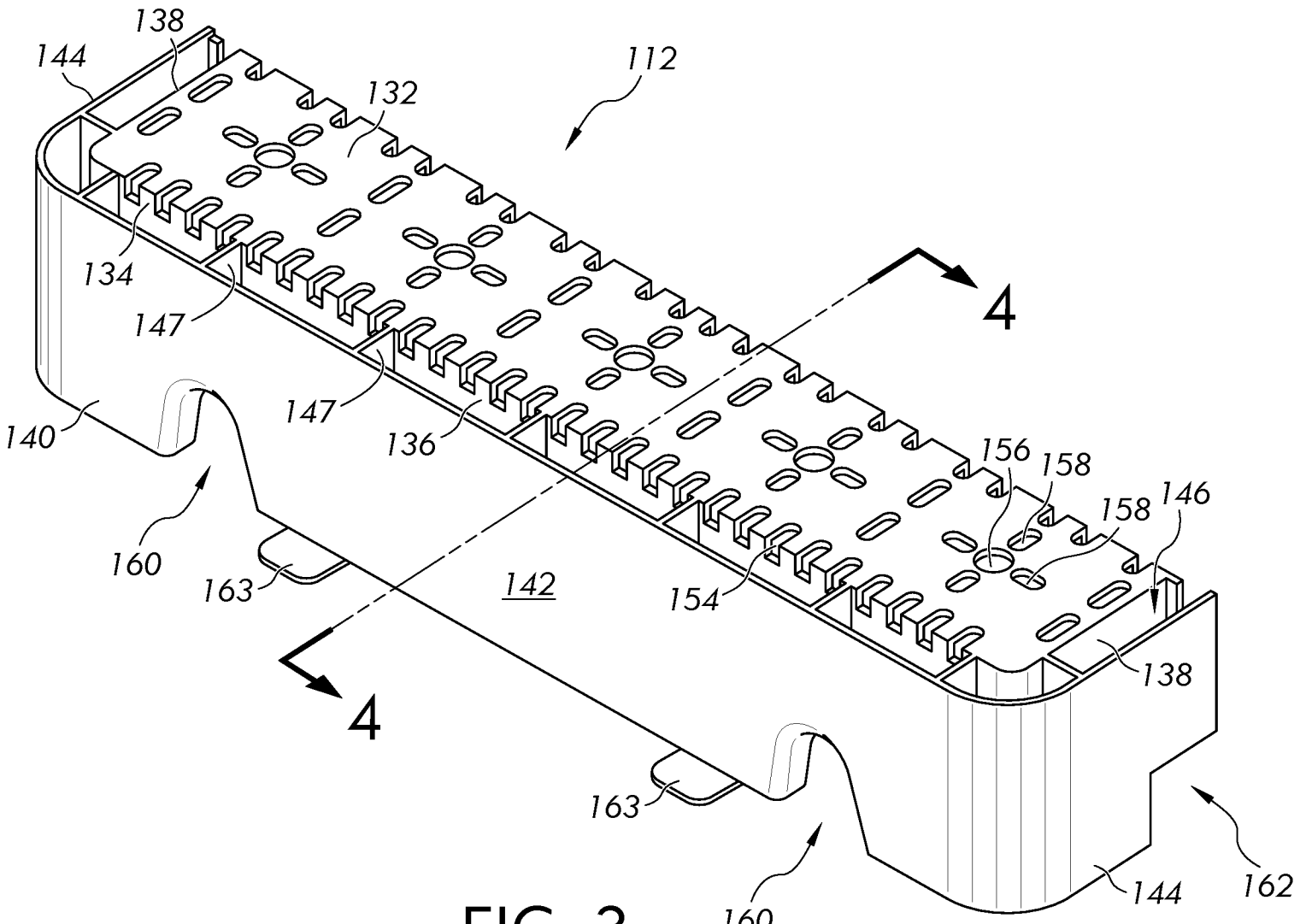
FIG. 3 is a front perspective view of the switch box of the control box assembly of FIG. 2.

With reference to FIG. 3, the switch box 112 includes a top wall 132 and a first barrier wall 134 extending downward about at least a partial perimeter of the top wall 132. In the illustrated embodiment the first barrier wall 134 is substantially U-shaped when viewed from above, extending downward from a front edge and opposing lateral edges of the top wall 132. Specifically, the first barrier wall 134 includes a first front wall portion 136 and first opposing side wall portions 138. The first front wall portion 136 extends downwards from the front edge of the top wall 132 and the first opposing side wall portions 138 extend downwards from the opposing lateral edges of the top wall 132, respectively. As such, as illustrated the first barrier wall 134 extends downward from three of the four edges of the top wall 132 (i.e., the front edge and the opposing lateral edges).

A second barrier wall 140 is disposed adjacent the first barrier wall 134, preferably substantially parallel and co-extensive therewith, to thereby define an air-insulation channel 146 therebetween. The second barrier wall 140 includes a second front wall portion 142 and second opposing side wall portions 144. Specifically, the second front wall portion 142 and the second opposing side wall portions 144 are located adjacent the first front wall portion 136 and the first opposing side wall portions 138, respectively. The second barrier wall 140 is spaced from the first barrier wall 134 along their respective lengths in order to define the air-insulation channel 146 therebetween. In this configuration, the air-insulation channel 146 has a substantial U-shape when viewed from above. A plurality of ribs 147 are disposed within the air-insulation channel 146 extending between the first and second barrier walls 134 and 140 at (preferably equally) spaced intervals. The ribs 147 fixedly secure the second barrier wall 140 to the first barrier wall 134 such that their relative spacing remains constant, thus reinforcing the insulation channel 146.

Figure 4:
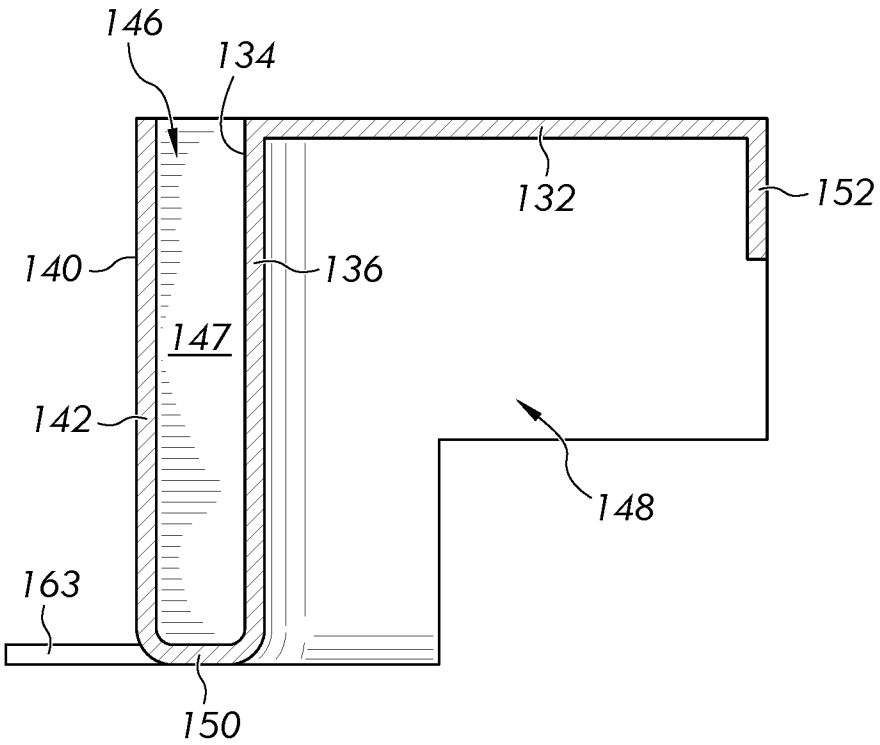
FIG. 4 is a cross-sectional view of the switch box of FIG. 3 taken along the line 4-4 therein.

As shown in FIG. 4, an internal chamber 148 of the switch box 112 is defined by the top wall 132 and the first barrier wall 134. The internal chamber 148 houses the switch(es) 114 therein. The second barrier wall 140 is spaced from the first barrier wall 134 in a direction outward and away from the internal chamber 148. A base wall 150 of the insulation channel 146 extends between bottom portions of the first and second barrier walls 134 and 140, such that the insulation channel 146 preferably has a substantially U-shaped cross-section when viewed in vertical cross-section as in FIG. 4. A rear wall 152 extends downward from a rear edge of the top wall 132, opposite the first front wall portion 136 of the first barrier wall 134. As depicted, the first barrier wall 134 and the rear wall 152 extend downward from the top wall 132 at respective first and second distances from the top wall 132, wherein the first distance is larger than the second distance.

The switch box 112 preferably is manufactured from plastic material such that all of its aforementioned components are integrally formed into a single-piece part. That is, the top wall 132, first barrier wall 134, second barrier wall 140, the plurality of ribs 147, the base wall 150, and the rear wall 152 are all integrally formed together from plastic.

Returning to FIG. 3, the switch box 112 includes a plurality of vent apertures 154 formed at an intersection (i.e. at the edge defined between) the top wall 132 and the first barrier wall 134. The vent apertures 154 vent air within the internal chamber 148 to an area outside of the switch box 112. A plurality of stem apertures 156 are formed through the top wall 132 of the switch box 112, which accommodate the passage of respective stems 122 from the plurality switches 114 housed within the internal chamber 148, on their way to (and through) the top plate 102. Further still, securing apertures 158 are formed through the top wall 132 of the switch box 112, and are aligned with respective plate second apertures 130 of the grounding plate 124 and the housing apertures 120 of respective switches 114 in order to permit fasteners 159 (e.g., screws, depicted in FIG. 2) to fixedly secure the switch box 112, grounding plate 124, switches 114 together.

As further shown in FIG. 3, the switch box 112 has a plurality of outlet ports 160 and a plurality of inlet ports 162 to permit cables to enter and exit the internal chamber 148 and electrically connect to switches 114 housed therein for communicating control inputs therefrom to operate the appliance.

The plurality of outlet ports 160 are formed as cutouts from the base of the air-insulation channel 146, through the first and second front wall portions 136, 142 of the first and second barrier walls 134, 140, respectively. The base wall 150 of that channel 146 follows the contour of the cutouts in order to seal the channel 146 against the outlet ports 160. Preferably a first outlet port 160 is disposed adjacent a first lateral end of the switch box 112 and a second outlet port 160 is disposed adjacent a second lateral end of the switch box 112.

The plurality of inlet ports 162 comprise first and second inlet ports 162 formed from the base of the air-insulation channel 146 respectively in opposing lateral ends thereof; i.e. through the respective first and second side wall portions 138, 144 of the first and second barrier walls 134, 140, at the lateral ends of the switch box 112. As with the outlet ports 160, the base wall 150 of the air-insulation channel 146 follows the contour of the inlet-port cutouts such that there is no direct fluid communication between the inlet ports 162 and the air-insulation channel 146. As shown, in a preferred embodiment the plurality of outlet ports 160 and inlet ports 162 are located such that the switch box 112 has a symmetrical configuration. Notably, as shown the first and second inlet ports 162 are disposed adjacent a rear end of the switch box 112 such that each is formed essentially as a square cutout, having no rear wall, and will thus be bounded at the rear by an external surface against which the rear portion of the switch box 112 abuts when installed.

The switch box 112 includes mounting tabs 163 that permit the switch box 112 to be mounted within the cooktop 100. Specifically, the mounting tabs 163 extend forward, away from the base of the second front wall portion 142 of the second barrier wall 140. The mounting tabs 163 are each configured to be inserted and received within complementary slots or brackets located in a base wall on which the switch box 112 is to be mounted within the cooktop 100 to fixedly secure the front portion of the switch box 112 thereto.

Figure 5:
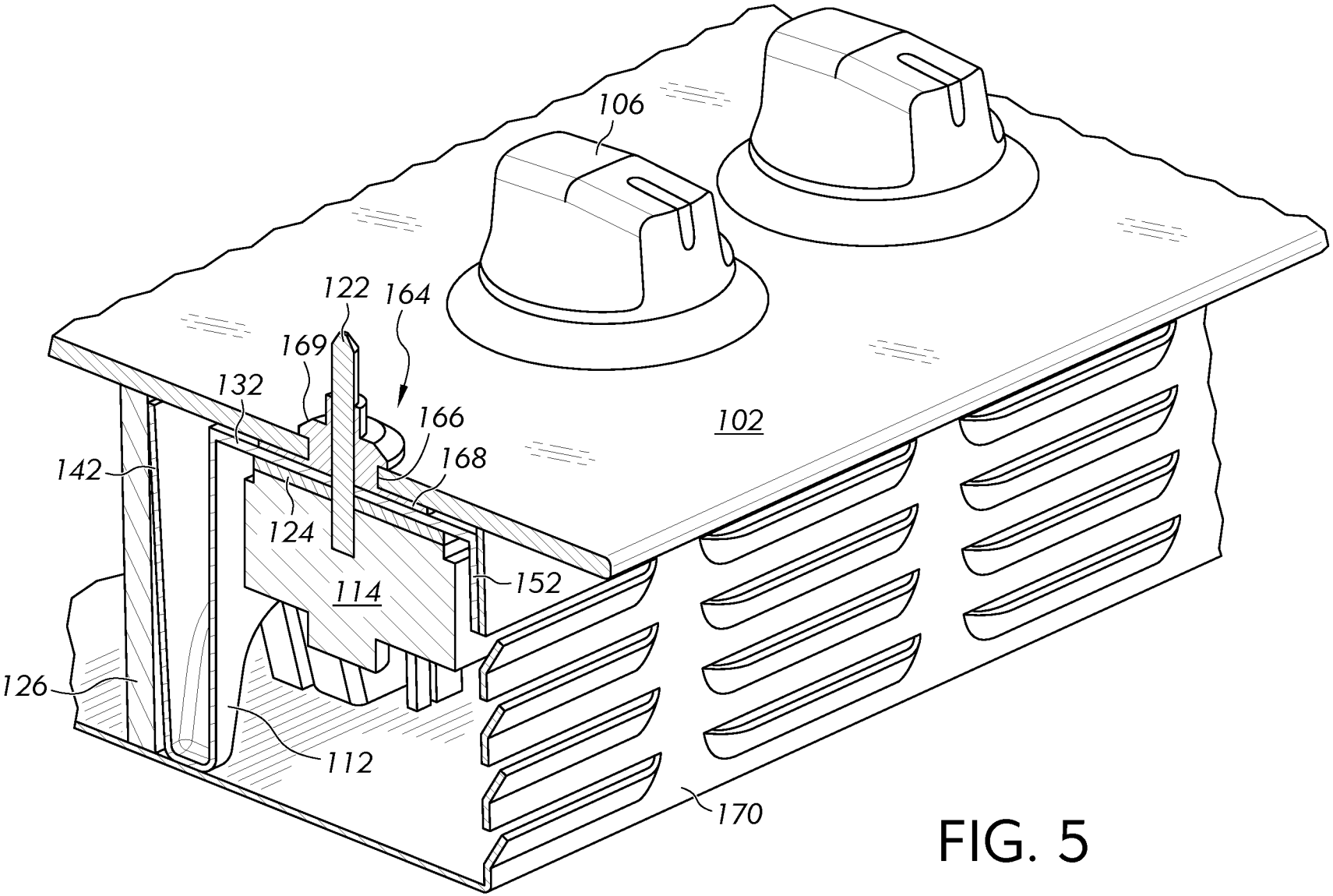
FIG. 5 is a perspective cross-sectional view of a cooking appliance, partially broken away, having the control box assembly of FIG. 2 installed therein.

Referring to FIG. 5, the control box assembly 110 is shown installed within a cooktop 100. The control box assembly 110 is provided directly beneath the top plate 102 of the cooktop 100. Specifically, a control member 106 is shown as a knob that is connected to an exemplary switch 114 via its stem 122. The switch 114 is disposed within the internal chamber 148 of the switch box 112. The grounding plate 124 is interposed between the switch 114 and the top wall 132 of the switch box 112. Moreover, the stem 122 extends through the plate first aperture 128 and the stem aperture 156 formed in the grounding plate 124 and the top wall 132 of the switch box 112, respectively.

An aperture is formed in the top plate 102 of the cooktop 100 to permit the stem 122 to extend therethrough. A ring gasket 164 is provided to seal the stem 122 to the top plate 102 in order to prevent debris from entering the control box assembly 110 through the top plate 102. The ring gasket 164 includes an annular recess 166 that accommodates the top plate 102 at the aperture formed therein. The annular recess 166 is defined between a flat base portion 168 and an annular top portion 169. The flat base portion 168 is interposed between a top surface of the top wall 132 of the switch box 112 and a bottom surface of the top plate 102 of the cooktop 100. The annular top portion 169 is provided above the top plate 102 and covers an annular ring portion of the upper surface of the top plate 102 surrounding the stem 122 in order to seal the aperture against spills.

As further shown, the outer insulation layer 126 surrounds an external surface of the second barrier wall 140. The outer insulation layer 126 comprises fiberglass and includes a plurality of apertures that align respectively with the plurality of outlet ports 160 and inlet ports 162 of the switch box 112 when the control box assembly 110 is fully installed. Notably, because the switch box 112 (including all such ports) is symmetrical, it can be utilized regardless whether control cables must enter/exit through or from either lateral portion of the switch box 112; that is, the switch box 112 is itself an ambidextrous part.

When installed, the switch box 112 is oriented such that an outer surface of the second front wall portion 142 of the second barrier wall 140 faces an internal area of the cooktop 100, and the rear wall 152 is disposed adjacent an interior side panel of the cooktop 100. Specifically, the side panel of the cooktop 100 is shown as being a vent panel 170. The vent panel 170 vents air within the switch box 112 to an area outside of the cooktop 100 to aid in preventing the switches 114 housed within the internal chamber 148 of the switch box 112 from overheating. Moreover, the top plate 102 of the cooktop 100 extends beyond the vent panel 170. Due to this configuration, the top plate 102 of the cooktop 100 obstructs a user's view such that the vent panel 170 is not ordinarily visible to a user, such that an aesthetically pleasing design is maintained.

Due to the configuration of the switch box 112, particularly the air-insulation channel 146 defined between the first and second barrier walls 134, 140, a plurality of insulation layers are not needed to prevent the switches 114 from overheating. That is, the outer insulation layer 126 and the air-insulation channel 146 ensure the switches 114 housed within the switch box 112 remain at satisfactory temperatures during operation of the cooking appliance. In other words, the switch box 112 can exclude additional insulation layers other than the outer insulation layer 126 and the air-insulation channel 146.

The invention has been described with reference to the example embodiments described above. Modifications and alterations will occur to others upon a reading and understanding of this specification. Example embodiments incorporation one or more aspects of the invention are intended to include all such modifications and alterations insofar as they come within the scope of the appended claims.

What is claimed is:

1. A switch box for housing a switch that is connected to a control member of a cooktop appliance, the switch box comprising:
   - a top wall;
   - a first barrier wall extending downward from an edge of the top wall;
   - a second barrier wall disposed adjacent and being spaced from the first barrier wall to thereby define an air-insulation channel therebetween; and
   - an internal chamber defined at least partially by the top wall and the first barrier wall, the internal chamber configured to house a switch therein.

2. The switch box of claim 1, said first barrier wall comprising a first front wall portion and first opposing side wall portions extending downward respectively from a front edge and from opposing lateral edges of said top wall, said second barrier wall comprising a second front wall portion and second opposing side wall portions located respectively adjacent and spaced from said first front wall portion and said first opposing side wall portions, such that said air-insulation channel is substantially U-shaped when viewed from above.

3. The switch box of claim 2, further comprising a base wall extending between bottom portions of the first barrier wall and the second barrier wall, such that said air-insulation channel has a substantially U-shaped vertical cross-section.

4. The switch box of claim 3, further comprising a plurality of vent apertures formed at an intersection between said top wall and said first barrier wall in order to vent air within the internal chamber to an area outside of the switch box.

5. The switch box of claim 1, further comprising a stem aperture formed through the top wall of the switch box in order to accommodate a stem of a switch housed within the internal chamber to extend through the top wall and out of the switch box.

6. The switch box of claim 1, further comprising a plurality of ribs disposed within the air-insulation channel, extending between said first and second barrier walls.

7. The switch box of claim 1, the top wall, the first barrier wall, and the second barrier wall all being integrally formed together from plastic as a single-piece part.

8. The switch box of claim 1, further comprising:

an outer insulation layer disposed adjacent an external surface of the second barrier wall of the switch box, the outer insulation layer adding an additional layer of insulation for a switch within the switch box.

9. The switch box of claim 2, further comprising:

first and second outlet ports formed as cutouts from a base of said air-insulation channel through said first and second front wall portions, said first and second outlet ports being disposed adjacent first and second lateral ends of the switch box, respectively; and first and second inlet ports formed as cutouts from the base of said air-insulation channel respectively in opposing lateral ends thereof, through said respective first and second opposing side wall portions, said first and second inlet ports and said first and second outlet ports being arranged so that said switch box is an ambidextrous part.

10. The switch box of claim 9, further comprising a base wall extending between bottom portions of the first barrier wall and the second barrier wall, such that said air-insulation channel has a substantially U-shaped vertical cross-section, said base wall following respective contours of said inlet ports and said outlet ports in order to seal the air-insulation channel against all said ports.

11. A cooking appliance comprising:

a cooktop having a top plate;

an electric heating element disposed at the top plate;

a control member located in a control area of the cooktop and accessible thereabove by a user in order to adjust a power output of the electric heating element; and a control box assembly disposed under the top plate beneath said control area, the control box assembly comprising a switch box housing a switch that is connected to the control member via a stem of the switch that extends through a stem aperture in the top wall of the switch box and through an aperture in said top plate, the switch box further comprising:

a first barrier wall extending downward from the top wall thereof;

an internal chamber at least partially defined by the top wall and the first barrier wall, said switch being housed in the internal chamber; and a second barrier wall disposed adjacent and being spaced from the first barrier wall to thereby define an air-insulation channel therebetween.

12. The cooking appliance of claim 11, the control box assembly further comprising a grounding plate disposed at a bottom surface of the top wall of the switch box, the grounding plate being in electrical communication with the switch in order to ground the switch.

13. The cooking appliance of claim 11, the control box assembly further comprising an outer insulation layer disposed adjacent an external surface of the second barrier wall of the switch box, the outer insulation layer adding an additional layer of insulation for the switch within the switch box.

14. The cooking appliance of claim 11, the switch box further comprising:

a base wall extending between bottom portions of the first barrier wall and the second barrier wall, such that said air-insulation channel has a substantially U-shaped vertical cross-section.

15. The cooking appliance of claim 11, the switch box further comprising a plurality of vent apertures formed at an intersection between said top wall and said first barrier wall in order to vent air within the internal chamber to an area outside of the switch box.

16. The cooking appliance of claim 11, said first barrier wall comprising a first front wall portion and first opposing side wall portions extending downward respectively from a front edge and from opposing lateral edges of said top wall, said second barrier wall comprising a second front wall portion and second opposing side wall portions located respectively adjacent and spaced from said first front wall portion and said first opposing side wall portions, such that said air-insulation channel is substantially U-shaped when viewed from above.

17. The cooking appliance of claim 16, the switch box further comprising:

first and second outlet ports formed as cutouts from a base of said air-insulation channel through said first and second front wall portions, said first and second outlet ports being disposed adjacent first and second lateral ends of the switch box, respectively; and first and second inlet ports formed as cutouts from the base of said air-insulation channel respectively in opposing lateral ends thereof, through said respective first and second opposing side wall portions, said first and second inlet ports and said first and second outlet ports being arranged so that said switch box is an ambidextrous part.

18. The cooking appliance of claim 11, the top wall, the first barrier wall and the second barrier wall all being integrally formed together from plastic as a single-piece part.

19. The cooking appliance of claim 13, the control box assembly excluding additional insulation layers other than the outer insulation layer and the air-insulation channel.

20. The cooking appliance of claim 13, the outer insulation layer comprising fiberglass.

* * * * *